US009623301B2

(12) United States Patent
Bamber

(10) Patent No.: US 9,623,301 B2
(45) Date of Patent: Apr. 18, 2017

(54) GOLF PUTTER

(75) Inventor: Jeffrey Vincent Bamber, Cincinnati, OH (US)

(73) Assignee: Pelican Golf, Inc., Cincinnati, OH (US)

( * ) Notice: Subject to any disclaimer, the term of this patent is extended or adjusted under 35 U.S.C. 154(b) by 2504 days.

(21) Appl. No.: 12/005,847

(22) Filed: Dec. 28, 2007

(65) Prior Publication Data

US 2008/0108450 A1 May 8, 2008

Related U.S. Application Data

(63) Continuation-in-part of application No. 11/357,313, filed on Feb. 17, 2006.

(60) Provisional application No. 60/877,830, filed on Dec. 30, 2006, provisional application No. 60/963,207, filed on Aug. 4, 2007.

(51) Int. Cl.
*A63B 53/04* (2015.01)

(52) U.S. Cl.
CPC .. *A63B 53/0487* (2013.01); *A63B 2053/0408* (2013.01); *A63B 2053/0441* (2013.01); *A63B 2053/0491* (2013.01)

(58) Field of Classification Search
CPC ..... A63B 53/0487
USPC ..... 473/340, 290, 341
See application file for complete search history.

(56) References Cited

U.S. PATENT DOCUMENTS

D137,064 S * 1/1944 Roberts ..... D21/726
D207,227 S 3/1967 Solheim
3,319,964 A 5/1967 Steinberg
D222,889 S 1/1972 Dziurgot
D232,371 S 8/1974 Becker
D234,782 S 4/1975 Creed
3,888,492 A 6/1975 Cabot
3,921,984 A 11/1975 Winter
(Continued)

OTHER PUBLICATIONS

Author Unknown, Never Compromise GM2 Exchange 3 Putter—Golf Equipment Review—Today's Golfer, Today's Golfer website, www.todaysgolfer.co.uk, downloaded Dec. 9, 2007 (shows a putter that, according to the manufacturer's website, was introduced Aug. 24, 2006).

(Continued)

*Primary Examiner* — Michael Dennis
(74) *Attorney, Agent, or Firm* — Jeffrey V. Bamber

(57) ABSTRACT

Golf clubs, and more particularly to a golf putter and a club head for a putter are disclosed. In one embodiment, the club head has a body having a club face, a first extension portion at the first end of the club face extending in a direction either outwardly, or rearwardly and outwardly away from the center of the club face; and a second extension portion at the second end of the club face extending in a direction either outwardly, or rearwardly and outwardly away from the center of the club face. In this embodiment, at least one of the first and second extension portions forms an angle of greater than or equal to about 40°, 45°, or some other suitable angle, and less than or equal to about 90° from an imaginary line oriented perpendicular to the club face and passing through at least one of the outermost portion of the club face at the heel or the toe of the club face. One or both of the extensions may have a weight joined thereto, which weight comprises a material having a specific gravity that is higher than that of at least a portion of the body of the club head.

2 Claims, 12 Drawing Sheets

(56) References Cited

U.S. PATENT DOCUMENTS

| | | | | |
|---|---|---|---|---|
| 4,034,989 | A | 7/1977 | Stewart | |
| 4,621,813 | A | 11/1986 | Solheim | |
| 4,650,191 | A * | 3/1987 | Mills | 473/341 |
| 4,741,535 | A | 5/1988 | Leonhardt | |
| D324,555 | S | 3/1992 | Evans | |
| 5,125,665 | A | 6/1992 | Sindelar, Sr. | |
| D355,944 | S | 2/1995 | Bendo | |
| 5,419,560 | A | 5/1995 | Bamber | |
| 5,540,437 | A | 7/1996 | Bamber | |
| D381,382 | S | 7/1997 | Fenton, Jr. | |
| D399,274 | S | 10/1998 | Bradford | |
| 5,951,412 | A | 9/1999 | Rose et al. | |
| D422,041 | S * | 3/2000 | Bradford | D21/736 |
| D443,320 | S | 6/2001 | Breier et al. | |
| D444,832 | S | 7/2001 | Pinter | |
| D447,526 | S | 9/2001 | Mathews, Jr. | |
| D447,781 | S | 9/2001 | Pechal | |
| 6,488,595 | B1 * | 12/2002 | Grace | 473/341 |
| D481,088 | S | 10/2003 | Mader | |
| D481,431 | S | 10/2003 | Wightman | |
| 6,702,693 | B2 | 3/2004 | Bamber | |
| 6,752,723 | B2 | 6/2004 | Cullen | |
| D500,539 | S | 1/2005 | Holloway | |
| D501,233 | S | 1/2005 | Thomas | |
| 6,896,625 | B2 | 5/2005 | Grace | |
| D514,182 | S | 1/2006 | Olsavsky et al. | |
| D516,655 | S | 3/2006 | Madore | |
| 7,018,304 | B2 * | 3/2006 | Bradford | 473/334 |
| D520,584 | S | 5/2006 | Karlsen | |
| D526,373 | S | 8/2006 | Brown | |
| D527,433 | S | 8/2006 | Hueber | |
| 7,086,957 | B2 | 8/2006 | Solheim et al. | |
| D529,109 | S | 9/2006 | Jones | |
| D529,560 | S | 10/2006 | Madore | |
| D531,242 | S | 10/2006 | Adams | |
| D540,897 | S | 4/2007 | Oldknow et al. | |
| D542,873 | S | 5/2007 | Oldknow | |
| 7,335,112 | B1 * | 2/2008 | Bitondo | 473/238 |
| 7,407,445 | B2 * | 8/2008 | Pedraza et al. | 473/314 |
| 7,431,659 | B2 * | 10/2008 | Williams et al. | 473/231 |
| 2003/0144075 | A1 | 7/2003 | Cullen | |
| 2003/0144077 | A1 | 7/2003 | Cullen | |
| 2005/0159240 | A1 | 7/2005 | Solheim et al. | |
| 2005/0239574 | A1 | 10/2005 | Rohrer | |
| 2005/0261080 | A1 | 11/2005 | Bradford | |
| 2006/0040765 | A1 | 2/2006 | Sano | |
| 2006/0058113 | A1 | 3/2006 | Hasegawa | |
| 2006/0094522 | A1 | 5/2006 | Tang et al. | |
| 2006/0148585 | A1 | 7/2006 | Vinton | |
| 2006/0183568 | A1 | 8/2006 | Bamber | |

OTHER PUBLICATIONS

Author Unknown, photographs of 1967 vintage Acushnet Bullseye putters, found on the internet on Aug. 10, 2014.

* cited by examiner

GOLF PUTTER

CROSS REFERENCE TO RELATED APPLICATIONS

This application claims the benefit of provisional patent application Ser. No. 60/877,830, filed Dec. 30, 2006 and provisional patent application Ser. No. 60/963,207, filed Aug. 4, 2007, and is a continuation-in-part of U.S. patent application Ser. No. 11/357,313, filed Feb. 17, 2006.

FIELD OF THE INVENTION

The present invention relates to golf clubs, and more particularly to a golf putter.

BACKGROUND OF THE INVENTION

Patents relating to golf clubs include U.S. Pat. Nos. 5,419,560; 5,540,437; and 6,702,693, and the references cited or listed therein, and U.S. Patent Application Publication No. US 2006/0183568 A1, Bamber. Patent publications relating to golf putter heads, or attachments thereto, include: U.S. Pat. Nos. 3,319,964; Des. 222,889; Des. 232,371; U.S. Pat. Nos. 3,888,492; 4,034,989; 4,741,535; Des. 324,555; U.S. Pat. No. 5,125,665; Des. 355,944; Des. 381,382; Des. 399,274; D444,832 S; D447,781 S; U.S. Pat. No. 6,488,595 B1; US 2003/0144077 A1; D481,088 S; D481,431 S; U.S. Pat. No. 6,752,723 B2; D500,539 S; D516,655 S; U.S. Pat. No. 7,018,304 B2; D520,584 S; U.S. Pat. No. 7,086,957 B2; and U.S. Patent Application Publication No. US 2006/0094522 A1.

Golf clubs must meet the requirements of the United States Golf Association Rules of Golf ("Rules of Golf") to be considered "legal" for tournament play. The USGA Rules require in Appendix II, Rule 4a, that:

> The club head must be generally plain in shape. All parts must be rigid, structural in nature and functional. It is not practicable to define plain in shape precisely and comprehensively but features which are deemed to be in breach of this requirement and therefore not permitted include:
>
> (i) holes through the head,
>
> (ii) transparent material added for other than decorative or structural purposes,
>
> (iii) appendages to the main body of the head such as knobs, plates, rods or fins,
>
> for the purpose of meeting dimensional specifications, for aiming or for any other purpose. Exceptions may be made for putters.
>
> Any furrows in or runners on the sole must not extend into the face.

The addition of the exception for putters is believed to have been added within the last several years. This Rule, particularly the prohibition on appendages, is believed to be the reason that most golf club heads currently on the market, including putters, do not have portions not used for striking a golf ball that extend significantly laterally outward beyond the striking face of the club head.

An example of the prior thought about this subject is contained in the Background of the Invention of U.S. Pat. No. 6,488,595 B1, which states:

> What is needed is a putter that provides a moment of inertia in the range of 12,000 to 28,000 grams per square centimeter (g/cm$^2$). Such a putter would enable a golfer to strike the ball near or at the toe or heel of the putter with little or no loss of accuracy in the shot, i.e., every spot on such a putter would provide a sweet spot.
>
> One possible approach would be to make a putter blade having a very long heel to toe distance measurement, and to attach very heavy weights to its outermost ends. Such a putter, however, would be impractical to use and unattractive to consumers. Moreover, the U.S. Golf Association (USGA) would not approve such a putter for tournament play. The challenge is to provide a putter having a super high moment of inertia that maintains its attractiveness and practicality and that is approved by the USGA for tournament play.

It is desired to make a putter with improved features, including, in some embodiments, a high moment of inertia, that will conform to the U.S.G.A. Rules of Golf.

SUMMARY OF THE INVENTION

The present invention relates to golf clubs, and more particularly to a golf putter. There are numerous, non-limiting embodiments of the invention. All embodiments, even if they are only described as being "embodiments" of the invention, are intended to be non-limiting (that is, there may be other embodiments in addition to these), unless they are expressly described as limiting the scope of the invention. Any of the features of the embodiments described herein can also be combined with the features of any other embodiments in any manner to form still other embodiments.

In one non-limiting embodiment, the invention relates to a golf putter-type club head comprising a body having a club face, a top portion, a sole portion, a toe portion, and a heel portion. The club face has a center, a first end at the toe portion, and a second end at the heel portion. The putter club head may have at least one extension extending in a direction either outwardly, or rearwardly and outwardly away from the club face. In one version of such an embodiment, the putter club head comprises a first extension at the first end of the club face extending in a direction either outwardly, or rearwardly and outwardly away from the club face, and a second extension at the second end of the club face extending in a direction either outwardly, or rearwardly and outwardly away from the club face. In one version of such an embodiment, at least one of the first and second extensions forms an angle of greater than or equal to about 40°, 45°, or some other suitable angle, and less than or equal to about 90° from an imaginary line oriented perpendicular to the club face and passing through at least one of the outermost portions of the club face at the heel or the toe of the club face. One or both of the extensions may have a weight joined thereto, which weight comprises a material having a specific gravity that is higher than that of at least a portion of the body of the club head.

Other embodiments are also contemplated. In other embodiments, for example, a different angle may be formed depending on the configuration of the club head. Numerous other embodiments are also contemplated. The club heads described herein can have a golf club shaft joined thereto with a grip thereon to form a golf putter.

BRIEF DESCRIPTION OF THE DRAWINGS

FIG. 2A is a top view an embodiment of a golf putter head having extensions of unequal length.

DETAILED DESCRIPTION OF THE INVENTION

The present invention relates to golf clubs, and more particularly to a golf putter. The putter club head may be heel and/or toe weighted. In other embodiments, the putter head need not be heel and/or toe weighted.

Figure 1:
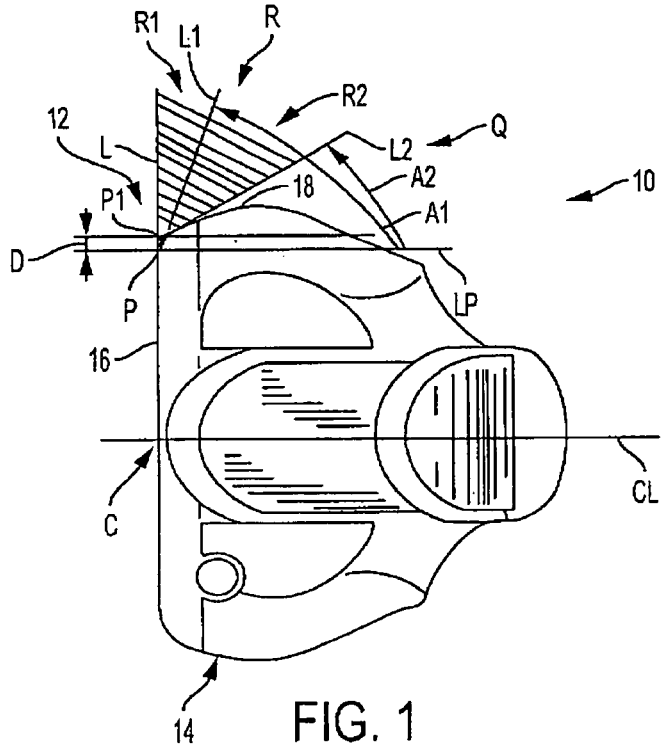
FIG. 1 PRIOR ART
FIG. 1 is a top view of a prior art golf putter head.

FIG. 1 show one example of a currently marketed putter head 10 such as shown in U.S. Pat. No. 7,086,957 B2. The club head 10 of the putter has a toe 12, a heel 14, and a club face 16. As shown in FIG. 1, there is a cross hatched region or area, R, disposed outward of the toe 12 of the club head 10 which no portion of the club head lies within. In the case of the club head 10 shown in FIG. 1, there will also be a second region (not shown) similar to region R that is disposed laterally outward of the heel 14 of the club head 10.

FIGS. 2-5 show one non-limiting embodiment of the golf putter head according to the present invention. In the embodiment shown in FIGS. 2-5, the golf putter club head 20 comprises a body having a club face 22, a top portion 24, a sole portion 26, a toe portion 28, and a heel portion 30. The club face 22 has a center C, a first end (or "toe end") 32 at the end of the club face closest to the toe portion 28, and a second end (or "heel end") 34 at the end of the club face closest to the heel portion 30. The putter club head 20 may have at least one extension E1 extending in a direction either outwardly, or rearwardly and outwardly away from the center C of the club face 22.

The term "outwardly", as used herein, refers to a direction in the plane of the club face 22 oriented in a direction away from the center C of the club face beyond the toe and heel ends 32 and 34. It should be understood that when the extension is described herein as extending in a direction outwardly away from the center C of the club face 22, this reference is in terms of directional orientation only. This description does not require that the extension originate from the center C of the club face 22.

The club face 22 may have any suitable length measured between the toe and heel ends 32 and 34, including but not limited to any range between: about 1 inch and about 7 inches; about 2 inches and about 6 inches; about 3 inches and about 5.5 inches; and about 3 inches and about 4.5 inches.

The putter club head 20 in the embodiment shown in FIGS. 2-5 comprises a first extension E1 at the first end 32 of the club face 22 extending in a direction either outwardly, or rearwardly and outwardly away from the club face. The putter club head 20 also comprises a second extension E2 at the second end 34 of the club face 22 extending in a direction either outwardly, or rearwardly and outwardly away from the club face. In some embodiments, at least a portion of the leading edge 40 of the extension E1 (or leading edge 42 of extension E2) falls with region R.

The region R lies in a quadrant Q. The quadrant Q is defined by a line L which is an extension of the plane of the club face 16 and a line, LP, drawn perpendicular thereto rearwardly of the plane of the club face. The line LP is drawn through the outward most point P of the club face 16, in this case at the toe 12 of the club head 10. The region R is disposed laterally outward (from the centerline CL of the club head) of the toe portion of the club head. The region R is bounded on one side by line L, and on the other side by one or more lines, such as L1 and L2 that form angles, A1 and A2, respectively, with line LP.

As discussed above, there may be more than one line, such as L1 and L2, which forms an angle with the line LP and contributes to define region R. The use of more than one line to define region R is needed in this instance due to the convex curvature of the periphery 18 at the toe of the club head that lies outward of outward most point P of the club face 16. More specifically, line L1 and line L define region R1 therebetween, but region R1 makes up only a portion of overall region R. Region R is also made up of region R2. Region R2 is generally defined by line L2 and line L. Line L2 forms an angle A2 relative to line LP that is less than angle A1. As shown in FIG. 1, the angle A2 is defined by line L2 that passes through point P1. Point P1 is offset outwardly a distance D along line L from point P since it is drawn tangentially to the curvature of the periphery 18 of the club head 10 at the toe portion of the club head.

The point P1 may be offset any suitable distance D from point P. Suitable distances D include, but are not limited to: 1/16 inch, 1/8 inch, 1/4 inch, 1/3 inch, 1/2 inch, and every 1/16 inch increment above 1/16 inch. Suitable distances D can also be expressed in terms of tenths of an inch, and include, but are not limited to: 0.1 inch, 0.2 inch, 0.3 inch, and every 0.1 inch increment above 0.1 inch. Suitable distances D can also be expressed in terms of millimeters, and include, but are not limited to: 1, 2, 3 mm, and every 1 mm increment above 1 mm.

It should be understood that the example of the club head 22 shown in FIGS. 2-5 has a relatively "extreme" or unusual configuration in terms of lengths, shapes, and angles of the various portions thereof. In other embodiments, the features of the club head 22 may, but need not be so extreme.

Figure 2:
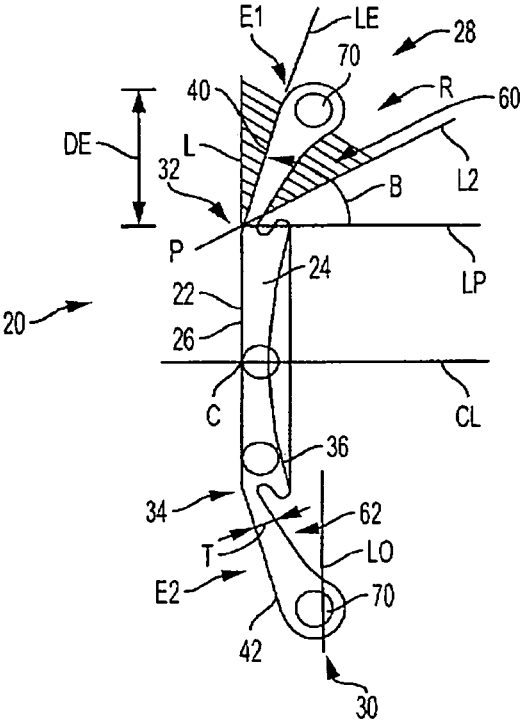
FIG. 2 is a top view one embodiment of a golf putter head according to the present invention.

As shown in FIG. 2, in this embodiment, the first and second extensions each have a leading edge, 40 and 42, respectively. The leading edge, such as leading edge 40 of the extension E1, is generally defined by a line LE that forms an angle, B, relative to line LP. The first and second extensions, E1 and E2, also each have a trailing edge, 44 and 46, respectively. For clarity of illustration, the trailing edges 44 and 46 are first numbered in FIGS. 6 and 7.

The angle, B, can be any suitable angle, depending on the configuration of the club head 20. For example, in cases where the extensions E1 and E2 are relatively shorter in length, the angle B may be greater. In cases where the extensions E1 and E2 are longer, the angle B may be less. In other embodiments, the opposite relationship may be present. Suitable angles for the angle B, in the case of some configurations, include, but are not limited to angles of greater than or equal to about 5°, 10°, 12°, 15°, 20°, 25°, 30°, 35°, 40°, 45°, 50°, 55°, 60°, 65°, 70°, 75°, 80°, to 85° up to less than or equal to about 90°, or any other angle between 0° and less than or equal to about 90°. The angle B may also fall within any range of angles between any of these numbers. In some embodiments, the angle B may, for example, fall within a range of greater than or equal to about 40°, 45°, or some other suitable angle, and less than or equal to about 90°.

It is also possible to express the angle formed by the leading edges 40 and 42 of the extensions E1 and E2 in an alternative manner. The angle formed by the leading edges of the extensions E1 and E2 can alternatively be expressed in terms of the angle the leading edges of the extensions E1 and E2 make with line L, the extension of the plane of the club face 22. In this case, the angle will be equal to 90° less the angle B, and the ranges of angle of interest may be expressed as being less than or equal to the specified angle.

The angle B formed by the extension at the toe 28 and at the heel 30 may be the same or different. The club head 20 can comprise extensions at the toe and at the heel with any combination of the angles described herein.

The extensions E1 and E2 may have any suitable length. The extensions have a proximal end 48 and 50, respectively, (labeled in FIGS. 6 and 7) nearest the club face 22 and the distal ends 52 and 54, respectively, which are disposed outwardly from the proximal ends of the extensions. The length of the extensions is the longest distance measured between the proximal end and the distal end of the extensions.

The extensions E1 and E2 may be of equal length. However, the extensions E1 and E2 are not limited to having the same length. For example, it may be desirable for the extensions E1 and E2 to be of equal length in the case of a center shafted putter (a putter head in which the shaft is inserted into the club head approximately midway between the toe and the heel). In other cases, for example, when the putter has a shaft that is located adjacent the heel of the putter head, it may be desirable for one of the extensions to be longer than the other. In such a case, for example, it may be desirable for the extension E2 to be longer than the extension E1. This may allow the putter to be face balanced so that when the putter is held by its shaft on the tip of one's finger and balanced with the club face facing upward, the club face will be parallel to the ground. In other cases,such as shown in FIG. 2A, extension E1 can be longer than extension E2. In other embodiments, the putter head can be balanced so that its toe is heavier, or its heel is heavier when balanced in such a manner.

The extensions E1 and E2 can be further described in terms of the distance they extend beyond the toe and/or heel ends of the club face 22 in a direction measured parallel to the club face 22. This distance is referred to herein as distance, DE. Distance, DE, can be greater than or equal to about 1/4 inch, 1/3 inch, 1/2 inch, 3/4 inch, 1 inch, or any 1/4 inch (6.35 mm) increment above 1 inch (2.54 cm). Distance, DE, can also be expressed as being greater than or equal to about 0.1 inch, 0.2 inch, 0.3 inch, . . . , etc., or any 0.1 inch increment, up to 5 inches. Alternatively, DE can be expressed as being greater than or equal to about 1 mm, 2 mm, 3 mm, . . . , etc., or any 1 mm increment, up to 12.5 cm. In some embodiments, DE may be less than or equal to about 0.5, 1, 2, 3, 4, or 5 inches, or any fraction of an inch, or tenth of an inch increment less than or between these numbers. The length of DE may also be selected to lie within any suitable range between any of the numbers in this paragraph.

Figure 15:
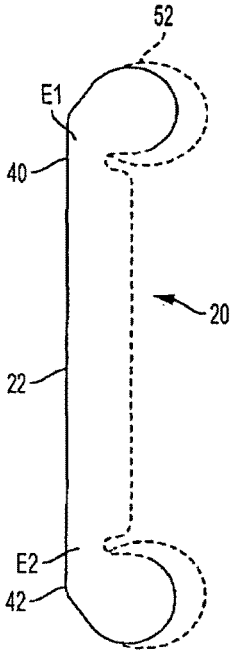
FIG. 15 is a top view of another alternative embodiment of a golf putter head with broken lines representing the boundaries thereof that do not form part of the invention shown therein.
Figure 16:
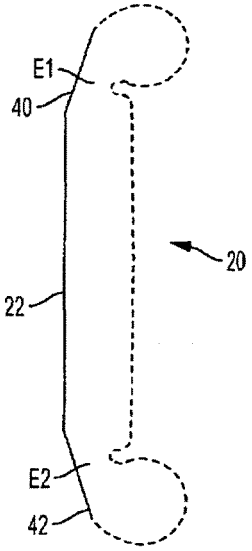
FIG. 16 is a top view of another alternative embodiment of a golf putter head with broken lines representing the boundaries thereof that do not form part of the invention shown therein.
Figure 17:
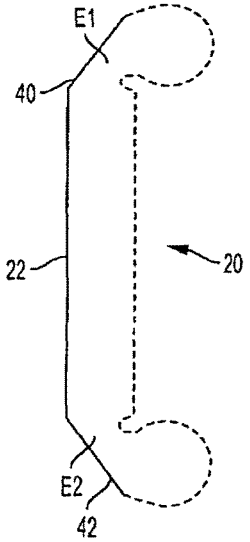
FIG. 17 is a top view of another alternative embodiment of a golf putter head with broken lines representing the boundaries thereof that do not form part of the invention shown therein.

The extensions E1 and E2 can be joined to any suitable portion of the remainder of the body of the club head 20. The extensions can be joined to the remainder of the body of the club head 20 at the ends of the toe or heel ends 32 and 34 of the club face 22. In other embodiments, the extensions E1 and E2 can be joined to the back surface 36 of club head 20 inward of the end of the toe of heel ends 32 and 34 of the club face. It may be desirable for U.S.G.A. approval, that the club head 20 to be configured so that the club face 22, the extensions E1 and E2, and the joinder of the extensions to the club face all present a surface that is considered to have one of the following configurations: flat, angular, or convex, or combinations thereof. With respect to angular surfaces, it may be desirable for the vertex of the angle to be disposed forward of at least one of the segments forming the angular portion (as shown in FIGS. 15-17). In other words, it may be desirable that the front surface of the club head 20 be free of concavities. In addition, the leading edges of the extensions E1 and E2 may, in some cases, have different configurations than the trailing edges to achieve conformance with U.S.G.A. rules.

Figure 4:
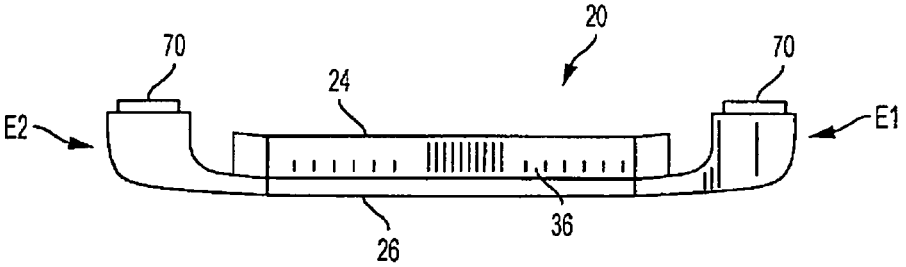
FIG. 4 is a rear view of the golf putter head shown in FIG. 2.

In any of these embodiments, the extensions E1 and E2 can be configured, oriented, or beveled, particularly along the sole 26, so that they will not cause the club head 20 to stub or snag the ground. FIG. 4 shows a rear view of a club head having the distal portions of its extensions disposed in a plane that lies vertically above the portion of the sole at the centerline CL of the club head. In addition, it may be desirable for the leading edge of the club head 20, particularly along the portion of the club face at the sole of the club head to be free of any furrows or concavities so that the club head conforms to U.S.G.A. rules.

Figure 7:
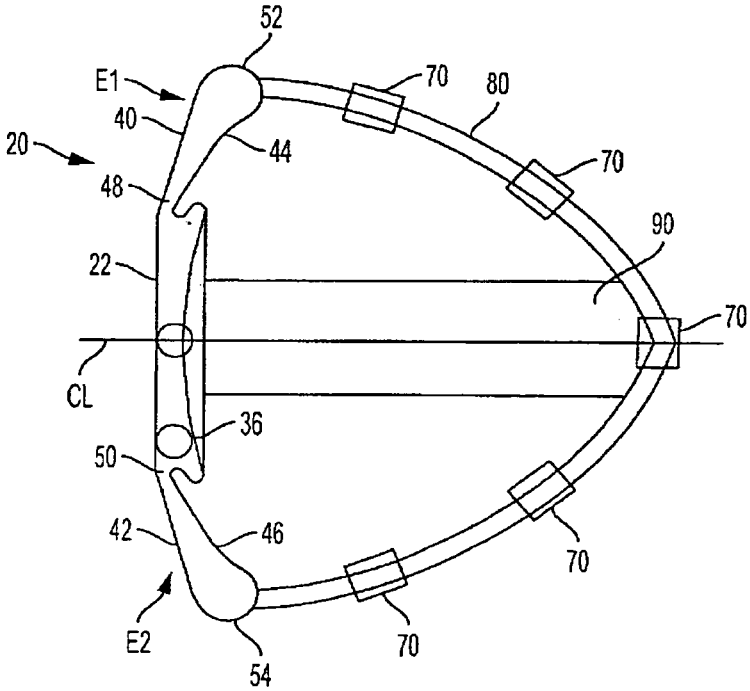
FIG. 7 is a top view of another alternative embodiment of a golf putter head which has a connector connecting the extensions.

As shown in FIG. 7, in some embodiments, the extensions may be joined to each other by a connector, such as by a peripheral element 80. FIG. 7 also shows that the club head 20 may further comprise a central element 90 that extends rearwardly from the rear surface of the club face along the centerline CL of the club head. In embodiments in which a connector 80 is present, the central element 90 may extend from the rear surface 36 of the club face 22 to the connector 80. In other embodiments, the central element 90 need not extend all the way to the connector 80.

As shown in FIG. 2, at least one of the extensions may have a trailing edge or surface 44 and 46 (labeled in FIGS. 6 and 7) with an indention (recess, or concavity) 60 and 62 therein (labeled in FIG. 2). The indentation(s) 60 and 62 may be of any suitable size and configuration. In some embodiments, it is desirable for at least portions of the indentation (s) 60 and 62 to be disposed at least partially laterally outward of the toe and/or heel ends 32 and 34 of the club face 22 in a direction taken parallel to the club face 22. In some embodiments, the entire indentation(s) 60 and 62 may be disposed laterally outward of the toe and/or heel ends 32 and 34 of the club face 22. In other embodiments, it is not necessary that the entire indentation(s) 60 and 62 be disposed laterally outward of the toe and/or heel ends 32 and 34 of the club face, only a portion thereof may be so disposed. In these latter embodiments, other portions of the indentation(s) 60 and 62 may be disposed laterally inward of the toe and/or heel ends 32 and 34 of the club face.

The indentations 60 and 62 may, as shown at the bottom of FIG. 2 relative to extension E2, lie at least partially inward (toward the club face 22) relative to a line, LO, drawn through the laterally outward most portion of the extension. In some cases, the laterally outward most portion of the extension may be discussed herein as either including, or excluding any weighted portions. In other embodiments, the indentations 60 and 62 may only lie inward of at least some other portions on the rear surface of the extensions.

The indentations 60 and 62 may be of any suitable size and shape. The indentations 60 and 62 may be of the same size and shape, or they may be of different sizes and shapes. The indentations 60 and 62 may have a width measured parallel to the club face 22 in the heel to toe direction. The indentations 60 and 62 may have a depth measured parallel to the centerline CL of the club head. In some embodiments, the width of the indentations 60 and 62 may be about 5%, 10%, 15%, 20%, 25%, 30%, 35%, 40%, 45%, 50%, 55%, 60%, 65%, 70%, 75%, 80%, 85%, 90%, 95%, up to less than or equal to 100% of the length of the extensions E1 and E2. In some embodiments, the depth of the indentations 60 and 62 may be about 5%, 10%, 15%, 20%, 25%, 30%, 35%, 40%, 45%, 50%, 55%, 60%, 65%, 70%, 75%, 80%, 85%, 90%, 95%, up to less than or equal to 100% of the distance between the forward most portion of the extension and the rearward most portion of the extension. In some cases, the depth of the indentations may be expressed as a percentage of the thickness of the extensions E1 and E2. In some embodiments, for example, the depth of the indentations 60 and 62 may be expressed as being greater than or equal to about 5%, 10%, 15%, 20%, 25%, 30%, 35%, 40%, 45%, 50%, 55%, 60%, 65%, 70%, 75%, 80%, 85%, 90%, 95%, 100%, . . . , etc. up to 150%, or more, of the thickness of the extensions E1 and E2, or some suitable portion thereof, such as the thickest portion, or thinnest portion of the extensions.

If desired, the indentations 60 and 62 may be filled with any suitable material, including but not limited to a material having a lower specific gravity than the body of the club head. Such materials include, but are not limited to aluminum, polymeric material, elastomers, and plastics.

The extensions E1 and E2 may have any suitable thickness or width, T. The extensions E1 and E2 may have a constant thickness T along their length. In other embodiments, the thickness of the extensions E1 and E2 may vary along the length of the extensions E1 and E2. The thickness of the extensions can be less than, or greater than, the thickness of at least some portions (or all portions) of the club face 22. The measurement of the relative thickness of the extensions (to the club face) may be specified herein alternatively as either including, or excluding, any flange such as on the sole of the club head, or any central element or alignment means extending from the back portion of the clubface. The regions where the extensions are joined to the remainder of the body of the club head 20 may be referred to herein as "transition regions" (or "transitions") 64 and 66 (See e.g., FIG. 6). The transitions 64 and 66 can also have any suitable dimensions, including but not limited to less than the thickness of either portions of the club face 22 or the extensions E1 and E2.

Figure 6:
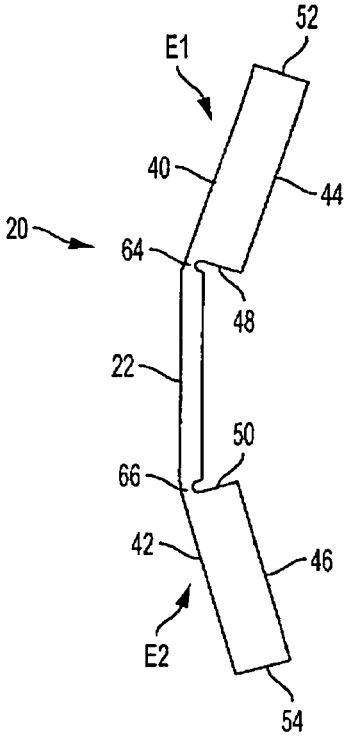
FIG. 6 is a top view of an alternative embodiment of a golf putter head.

As shown in FIG. 6, in some embodiments, the extensions E1 and E2 may be of relatively uniform width so that the respective leading edges 40 and 42 of the extensions and the trailing edges 44 and 46 of the extensions may be substantially parallel to each other. In other embodiments, as shown in FIG. 2, the leading edges 40 and 42 of the extensions and the trailing edges 44 and 46 of the extensions may configured so that the width of the extensions increases from the proximal ends 48 and 50 of the extensions (that is, the end nearest the club face) to the respective distal ends 52 and 54 of the extensions. In still other embodiments, the extensions may be configured in the opposite manner where the width of the extensions decreases from the proximal end of the extensions to the distal ends of the extensions.

In embodiments where the extensions E1 and E2 have portions having a width that differs along the length of the extensions, there can be any suitable proportion of difference in width between the widest portion of the extensions and the narrowest portion of the extensions. For instance, the width of the extensions at their narrowest portion may be less than or equal to about 95%, 90%, 85%, 80%, 75%, 70%, 65%, 60%, 55%, 50%, 45%, 40%, 35%, 30%, 25%, 20%, 15%, 10%, or 5%, of the width of the extensions at their widest portion.

Figure 3:
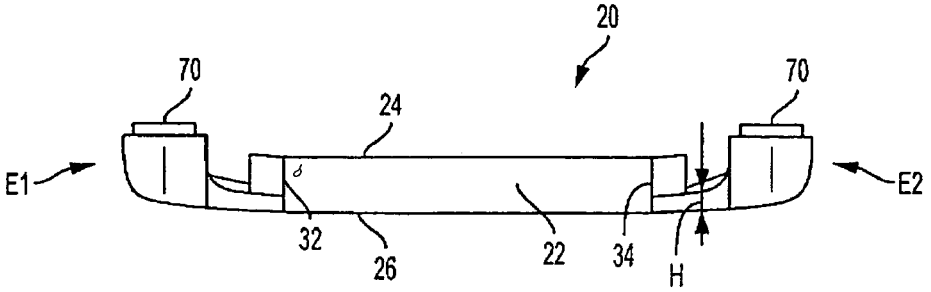
FIG. 3 is a front view of the golf putter head shown in FIG. 2.

The extensions E1 and E2 may have any suitable height, H, measured in a direction from the portion of the extension that lies nearest in elevation to the sole 26 of the club head 20 to the top surface of the extension (see FIG. 3). The extensions E1 and E2 may have a constant height H along their length. In other embodiments, as shown in FIG. 3, the height of the extensions E1 and E2 may vary along the length of the extensions E1 and E2. For instance, as shown in FIG. 3, the height of the extensions may vary from a lesser height at the proximal end of the extensions to a greater height at the distal end of the extensions. In other embodiments, the opposite relationship may be present. The height of the extensions can be less than or equal to, or greater than the height of at least some portions (or all portions) of the club face 22. The transitions 64 and 66 can also have any suitable height, including but not limited to less than or equal to, or greater than, the height of either portions of the club face 22 or the extensions E1 and E2. The height of the extensions and/or transitions can vary from their greatest height to their smallest height by any of the percentages specified above for the variances in the width of the extensions.

The main body of the club head 20 can be made of any suitable material or materials. Suitable materials include, but are not limited to stainless steel, titanium, graphite, aluminum, polymeric material, plastic, or combinations thereof.

As shown in FIGS. 2-5, any of these embodiments may have weights 70 of higher specific gravity material joined thereto at any portion of the club head 20, including to the extensions. As used herein, the term "higher specific gravity material" refers to a material having a higher specific gravity than the material comprising at least some of the other portions of the main body of the club head 20. Suitable higher specific gravity materials include, but are not limited to lead, brass, tungsten, and combinations thereof.

The club head 22 can have any suitable number of weights 70. Suitable numbers of weights 70 include, but are not limited to: 1, 2, 3, 4, 5, 6, 7, 8, . . . , etc. The weights 70 can be of any suitable configuration and size. As shown in the drawings, it is not necessary that all of the weights 70 have the same configuration, or be of the same size. If there is more than one weight 70, any two or more weights 70 may differ in configuration and/or size. The weights 70 can have any of the characteristics described for the higher specific gravity weighting portions disclosed in U.S. Patent Application Publication US 2006/0183568 A1, published Aug. 17, 2006.

The weights 70 can be of any suitable size. The weights 70 can be smaller or larger in dimensions than at least a portion of the club face 22 and/or at least a portion of the extensions E1 and E2. The weights 70 can have all their dimensions smaller or larger than at least a portion of the club face 22 and/or at least a portion of the extensions E1 and E2. Alternatively, the weights 70 can have some dimensions that are smaller than, and some dimensions that are larger than at least a portion of the club face 22 and/or the extensions E1 and E2. In the embodiment shown in FIGS. 2-5, the weights 70 have a maximum plan view dimension (which, in this case, is their diameter) that is larger than the width of the proximal ends 48 and 50 of the extensions E1 and E2, but is smaller than the distal ends 52 and 54 of the extensions. In non-limiting examples, the weights 70 can range in size from a maximum dimension that is less than or equal to about ¼ inch to a maximum dimension that is greater than or equal to the size of a golf ball (maximum diameter of 1.68 inches (42.7 mm)), or more.

The weights 70 can have any suitable shape. The weights 70 may have a regular-shaped, or an irregularly-shaped configuration. The weights 70 may also comprise structures that have one or more regularly-shaped sides and one or more irregularly-shaped sides. The weights 70 may be symmetrical, or asymmetrical about one or more axis. The axes of the particular shape can be oriented in any suitable direction when placed in the putter head. The weights 70 can have rectilinear shapes, curvilinear shapes, or they can comprise portions having both types of shapes. The aforementioned shapes can be seen when the weights 70 are viewed from a given direction (including, but not limited to the top surface of the club head 20). Examples of regular-shaped configurations include, but are not limited to: cubes, parallelepipeds, prisms, any other known polygon shapes, spheres, cylinders, and other geometric shapes. In some embodiments, however, it may be desirable for the weights 70 to exclude certain of these configurations (e.g., spherical or cylindrical).

The body of the club head 22, and/or the extensions E1 and E2, may have recesses or indentations in any of the surfaces thereof to receive at least a portion of the weights 70. Such recesses or indentations may be of any suitable configuration.

The weights 70 can be joined to the club head 20 in any suitable manner. Suitable manners for joining the weights 70 include, but are not limited to: adhesive attachment, welded connections, threaded connections, friction fitting, casting in place, and by at least partially by covering or enclosing the weights 70 with another element. In some embodiments, however, it may be desirable for the manner of joining the weights 70 to the body of the club head 20 to exclude one or more of such types of attachments.

The weights 70 can be permanent (that is, non-removable or non-adjustable) portions of the club head 20, or they can be adjustable. If it is desired for the weights to be adjustable, they can be in any known configuration which is suitable for adjustability. Suitable configurations include, but are not limited to those disclosed in U.S. Pat. No. 6,896,625 B2, Grace; or U.S. Pat. No. 7,018,304 B2, Bradford.

Figure 5:
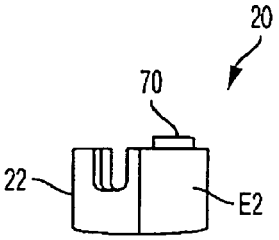
FIG. 5 is a side view of the golf putter head shown in FIG. 2.

FIGS. 2-5 show a club head 20 that is provided with a pair of cylindrical weights 70 of higher specific gravity material that are located in recesses in the bulbous protrusions near the distal ends of the extensions E1 and E2. As shown in FIGS. 3-5, these weights 70 may protrude vertically above the top surface of the remaining portions of the extensions. In other embodiments, the weights 70 need not protrude from the top surface of the extensions.

Any of the embodiments described herein may have weights 70 of higher specific gravity material joined thereto at any portion of the club head 20, including on the extensions E1 and E2, on the connector 80, and/or on the central element 90.

Figure 8:
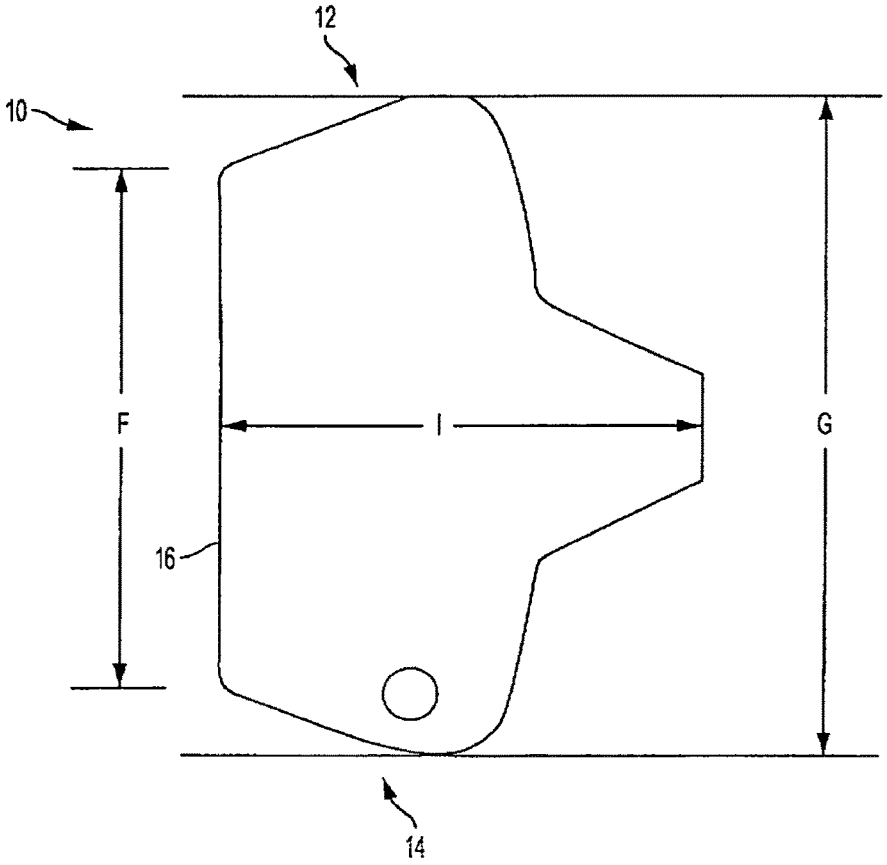
FIG. 8 PRIOR ART
FIG. 8 is a top view of a prior art golf putter head showing the U.S.G.A. dimensional requirements.
Figure 9:
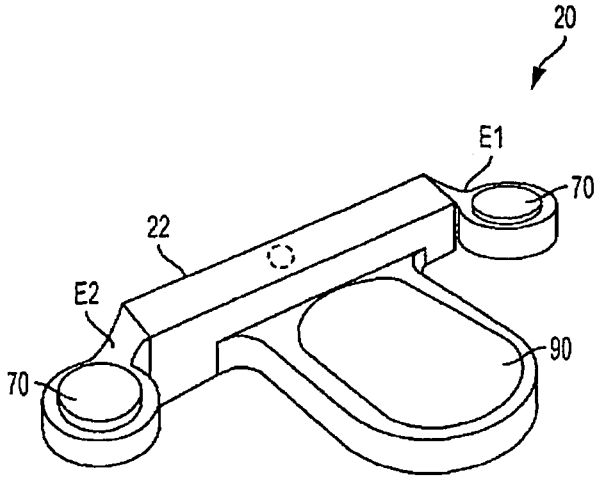
FIG. 9 is a perspective view of another alternative embodiment of a golf putter head according to the present invention.
Figure 10:
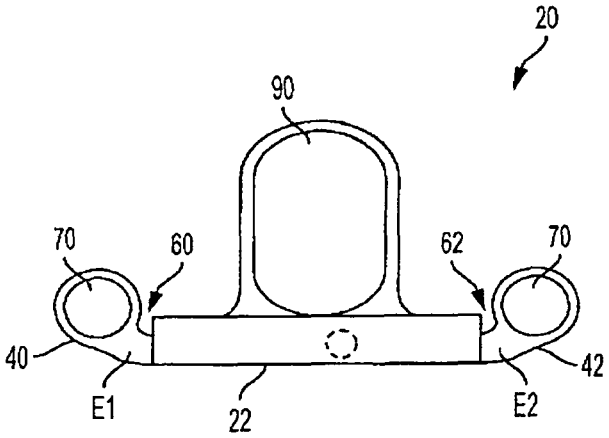
FIG. 10 is a top view of the putter head shown in FIG. 9.
Figure 11:
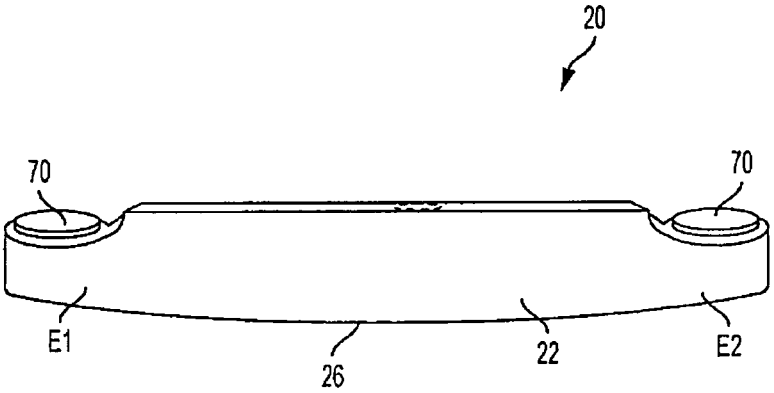
FIG. 11 is front view of the putter head shown in FIG. 9.
Figure 12:
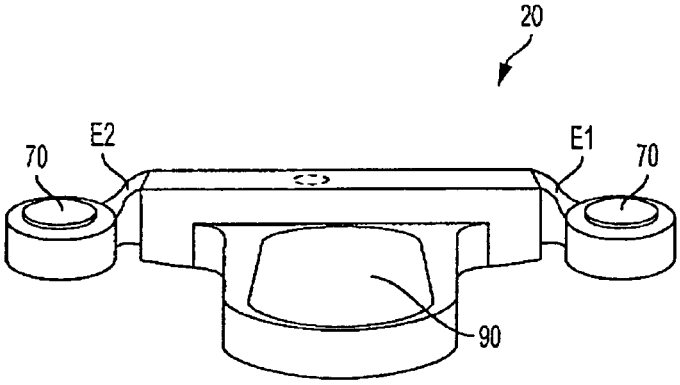
FIG. 12 is a rear perspective view of the putter head shown in FIG. 9.
Figure 13:
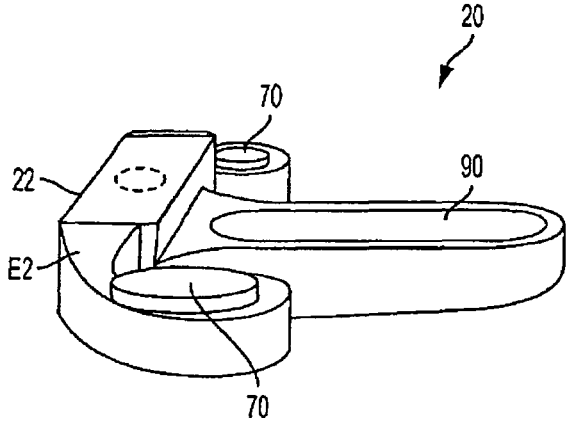
FIG. 13 is a side perspective view of the putter head shown in FIG. 9.
Figure 14:
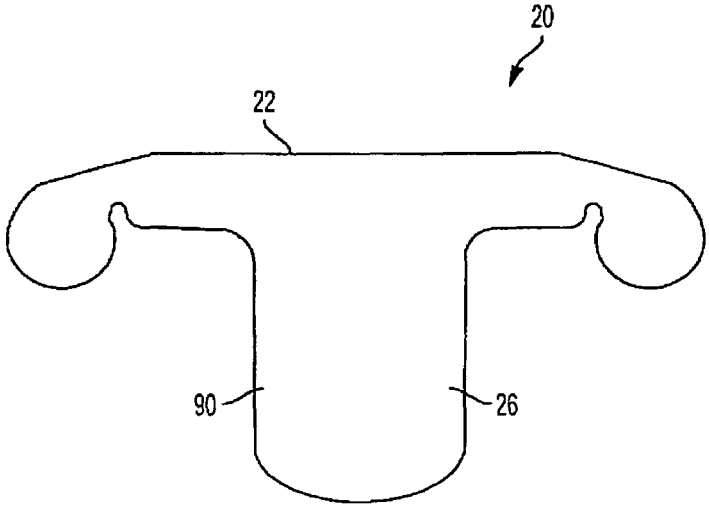
FIG. 14 is a bottom view of the putter head shown in FIG. 9.

The configuration of the club head 20 may be such that the club head complies with the rules and guidelines of the United States Golf Association (U.S.G.A.). It may, therefore, as shown in FIG. 8, it may be desirable for the distance, G, from the heel to the toe of the putter head to be not greater than 7 inches (177.8 mm). In addition, in such embodiments, the distance, F, from the heel to the toe of the putter face may be no less than ⅔ of the distance, I, from the front to the back of the putter head. Further, in such embodiments, the distance, F, from the heel to the toe of the putter face may be no less than ½ the distance, G, from the heel to the toe of the putter head. In addition, the distance, G, from the heel to the toe of the putter head may be greater than the distance, I, from the front to the back of the putter head. Also, in such embodiments, the distance from the sole to the top of the putter head, including any features, may not be greater than 2.5 inches (63.5 mm).

The extensions E1 and E2 and the weights 70 can serve any suitable purpose including, but not limited to increasing the efficiency of the weighting of the club head. This may (is hypothesized to) allow the club head 20 to be swung more accurately along a straight back and forth path. It is not necessary, however, that the club head provide any such benefits unless such benefits are expressly included in the appended claims. The extensions E1 and E2 need not be provided for the sole purpose of meeting any of the U.S.G.A. dimensional specifications described above.

Numerous other embodiments are possible. Several of the following embodiments can comprise separate inventions and/or designs in their own right.

FIGS. 9-14 show a golf putter head having an alternative configuration comprising extensions E1 and E2 and weights 70.

FIGS. 15-17 show three alternative embodiments of the top view of a golf putter head 20. As shown in FIG. 15, the size of the distal portion 52 of the extensions E1 and E2 may vary, including but not limited to from any size between the inner and outer dashed lines shown in the upper portion of FIG. 15. The shape of the distal portion of the extensions can also vary to accommodate any of the configurations and orientations of the weights 70 described herein. The same applies to the distal portions of the extensions shown in FIGS. 15-17, and any of the other figures shown herein.

Although the leading edges 40 and 42 of the extensions on the embodiments shown in FIGS. 15-17 are shown as being rectilinear when the putter head is viewed from the top, in alternative embodiments, these leading edges 40 and 42 can comprise one or more rectilinear segments, one or more convex curvilinear segments, or a combination of both types of segments.

Figure 18:
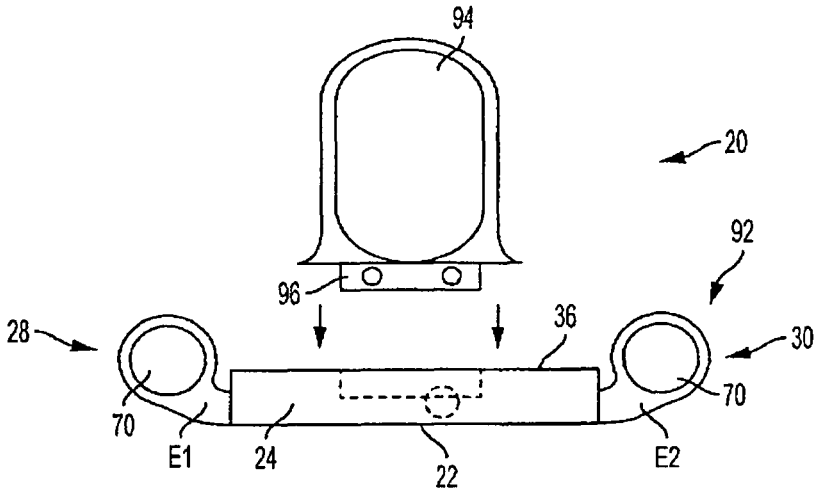
FIG. 18 is a top view of another alternative embodiment of a golf putter head with an attachment for changing the configuration of the putter head.

FIG. 18 shows one non-limiting embodiment of a golf putter head 20 which comprises an attachment for changing the configuration of the putter head 20. In one embodiment, the putter head 20 is convertible between a "blade"-type configuration and a "mallet"-type configuration. The putter head 20 shown in FIG. 18 comprises a main body 92 having a club face 22, a rear surface 36, a top portion 24, a sole portion, a toe portion 28, and a heel portion 30. The putter head 20 may, but need not, have extensions E1 and E2 and weights 70 as in the case of the previously-described embodiments.

The attachment 94 in the embodiment shown in FIG. 18 can have any suitable configuration. The attachment 94 may comprise a material having a specific gravity that is the same as, less than, or greater than that of the main body 92. The attachment 94 may be used for the purpose of weighting, adding an aiming or alignment feature, for changing the configuration of the club head, or for any other suitable purpose. It may be desirable for the attachment 94 to be of a size that is greater than or equal to any of the following percentages of the main body: 5%, 10%, 15%, 20%, 30%, 35%, 40%, 45%, 50%, 55%, 60%, 65%, 70%, 75%, 80%, 85%, 90%, 95%, 100%, . . . , etc., up to 150%, or more of the size of the main body, or within any range lying between any two of these percentages. The size of the attachment 94 can be expressed in terms of the top plan view area of the main body 92 and the attachment 94; in terms of the total volume of water displaced by the main body 92 and the attachment 94; or, both. In one non-limiting embodiment, the attachment 94 can have a length (perpendicular to the club face) and a width (parallel to the club face) that is greater than or equal to one or more times the width of a golf ball (1.68 inches (42.7 mm)).

The attachment 94 is temporarily connectable or releasably connected to the main body 92. The putter head 20 may also be described as being adjustable by either the addition or removal of the attachment 94. It may be desirable for the attachment 94 to be joined to, or removed from the main body 92 prior to commencement of a round of golf (and not during a round) so that it is more likely to conform to the U.S.G.A. Rules of Golf.

The attachment 94 can be joined to the main body 92 with an attachment connector 96 located on at least one of the main body 92 or the attachment 94. The attachment connector 96 can be in the configuration of a flange in any suitable configuration. In one embodiment, the attachment connector 96 may be in the configuration of a flange joined to the rear portion of the main body 92, along the sole thereof. In an alternative embodiment, as shown in FIG. 18, the attachment connector 96 can be in the configuration of a flange joined to the front portion of the attachment 94. The attachment 94 can be secured to the main body 92 by any suitable type of fasteners, including but not limited to a pair of screws that fit through the holes in the flange.

Figure 19:
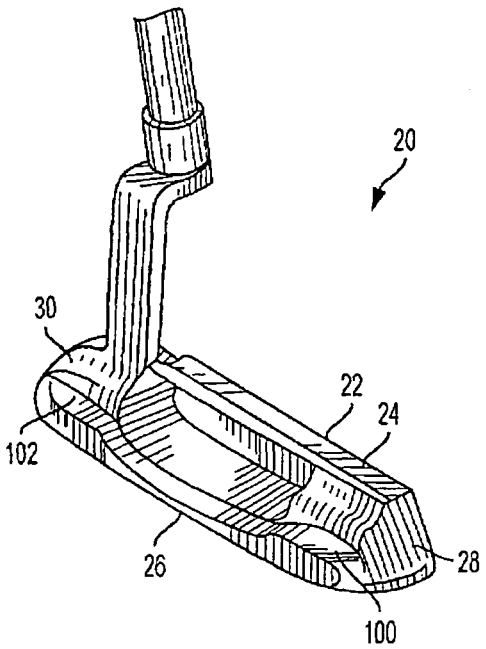
FIG. 19 is a rear perspective view of a multiple component golf putter head.
Figure 20:
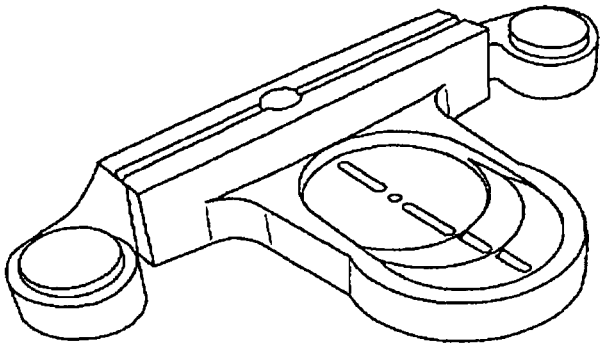
FIG. 20 is another perspective view of the alternative embodiment of a golf putter head shown in FIG. 9.
Figure 21:
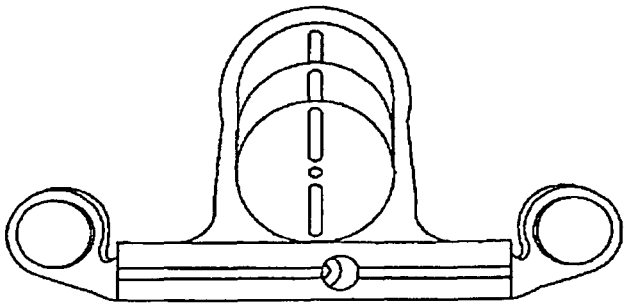
FIG. 21 is another top view of the putter head shown in FIG. 10.
Figure 22:
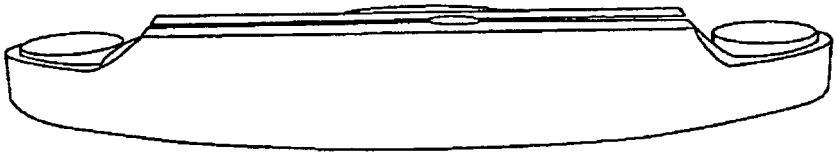
FIG. 22 is another front view of the putter head shown in FIG. 11.
Figure 23:
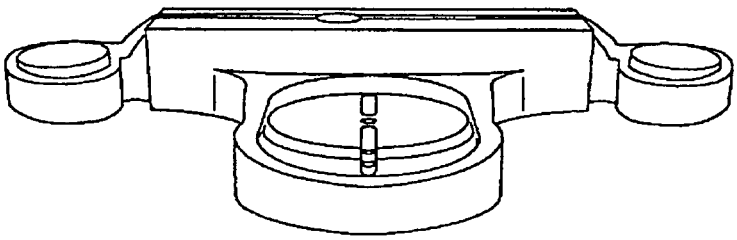
FIG. 23 is another rear perspective view of the putter head shown in FIG. 12.
Figure 24:
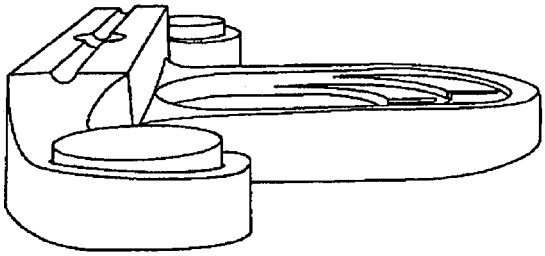
FIG. 24 is another side perspective view of the putter head shown in FIG. 13.
Figure 25:
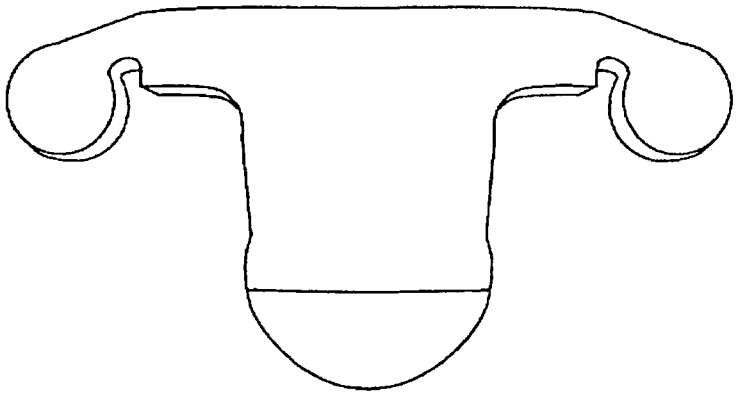
FIG. 25 is another bottom view of the putter head shown in FIG. 14.

FIG. 19 shows an embodiment of a multiple component putter head 20. As shown in FIG. 19, the putter head 20 comprises a body having a club face 22, a top portion 24, a sole portion 26, a toe portion 28, and a heel portion 30. As shown in FIG. 19, the putter head 20 has a toe and heel weighted configuration. As shown, there are portions having a stepped configuration which provide a larger mass at the toe and heel. In addition to having larger mass portions at the toe and heel, in the embodiment described herein, at least a portion 100 and 102 of these larger mass portions can comprise a separate piece that is comprised of higher specific gravity material than the remainder of the body of the putter head 20.

FIGS. 20-25 are alternative depictions of a golf putter head such as that shown in FIGS. 9-14.

The club face 22 of the putter heads 20 described herein may have any suitable loft. Suitable lofts may, for example, range from greater than or equal to about 2 degrees to less than or equal to about 6 degrees. Alternatively, the loft of the putter head may be between about 3-5 degrees. One suitable loft for the putter head is about 4 degrees.

The club head can have a center of gravity in any suitable location. The club head can have a majority of the putter head mass positioned above a horizontal center plane. Alternatively, the putter head may have a majority of its mass positioned below a horizontal center plane.

The club head can be made in any manner known in the art including, but not limited to investment casting, forging, milling, or combinations thereof. Combinations of these methods can be used to form one or more portions of the club head that are joined together. Suitable manners for joining such portions together include, but are not limited to using mechanical fasteners, adhesives, welds, friction fitting, or any other known manners of attachment.

The term "joined", as used herein, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined" includes both those configurations in which an element is temporarily joined to another element, or in which an element is permanently joined to another element.

The putter head 20 can be provided with a golf club shaft that is joined to the club head in a center-shafted, or a heel-shafted arrangement. Openings for insertion of the tip end of a golf club shaft are shown in several of the drawing figures. In some embodiments, it may be desirable for the putter head to have only a single opening therein for inserting the tip end of a golf club shaft. In other embodiments, a putter head can be provided with more than one opening so that there is more than one choice for locating the attachment of the shaft. If desired, two, three, or more openings can be provided for receiving a shaft. The openings may have the same configuration, or different configurations. The openings may be formed into the putter head at any suitable angle. The openings may be formed into the putter head at the same angle, or at different angles. For example, one opening can be provided to provide a center-shafted club head, and one opening can be provided to provide a heel-shafted club head. The openings can be circular, or some other configuration, including but not limited to rectangular, so as to accommodate a hosel and shaft arrangement such as that shown in FIG. 19. In order to comply with the Rules of Golf, it may be desirable for only one of said openings is used to receive a golf club shaft, and that there only be a single shaft with a single tip. If there is more than one opening, a plug can be provided for covering any opening that is not used. The butt end of the shaft can have a grip thereon to complete the assembly of the putter.

The disclosure of all patents, patent applications (and any patents which issue thereon, as well as any corresponding published foreign patent applications), and publications mentioned throughout this patent application are hereby incorporated by reference herein. It is expressly not admitted, however, that any of the documents incorporated by reference herein teach or disclose the present invention.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation.

What is claimed is:

1. A golf putter-type club head comprising:

a body having a club face, a top portion, a sole portion, a heel portion, and a toe portion, wherein said club face has a center, a first end at said heel portion, and a second end at said toe portion, said body being comprised of a material having a first specific gravity;

a first extension portion extending in a direction either outwardly in a direction in the plane of the club face oriented directionally away from the center of the club face beyond the first end, or rearwardly and outwardly away from the first end of the club face, said first extension portion having a leading edge, a proximal end in the region of the first end of said club face, and a distal end disposed away from said club face, said first extension having a weight joined thereto in the region of the distal end thereof, said weight having a second specific gravity higher than said first specific gravity; and a second extension portion extending in a direction either outwardly in a direction in the plane of the club face oriented directionally away from the center of the club face beyond the second end, or rearwardly and outwardly away from the second end of the club face, said second extension portion having a leading edge, a proximal end in the region of the second end of said club face, and a distal end disposed away from said club face, said second extension having a weight joined thereto in the region of the distal end thereof, said weight having a second specific gravity higher than said first specific gravity, wherein the leading edge of at least one of said first and second extension forms an angle of greater than 40° and less than 90° from an imaginary line oriented perpendicular to the club face and passing through at least one of the outermost portions of the club face at the heel or the toe of the club face, and wherein one of the extensions is longer than the other extension, wherein the weights have a thickness dimension measured in a direction from the front of the extensions to the rear of the extensions, wherein the thickness of at least one of the weights is greater than the thickness of at least a portion of one of the extensions.

2. A golf putter-type club head comprising:

a body having a club face, a top portion, a sole portion, a heel portion, and a toe portion, wherein said club face has a center, a first end at said heel portion, and a second end at said toe portion, said body being comprised of a material having a first specific gravity;

a first extension portion extending in a direction either outwardly in a direction in the plane of the club face oriented directionally away from the center of the club face beyond the first end, or rearwardly and outwardly away from the first end of the club face, said first extension portion having a leading edge, a proximal end in the region of the first end of said club face, and a distal end disposed away from said club face, said first extension having a weight joined thereto in the region of the distal end thereof, said weight having a second specific gravity higher than said first specific gravity; and a second extension portion extending in a direction either outwardly in a direction in the plane of the club face oriented directionally away from the center of the club face beyond the second end, or rearwardly and outwardly away from the second end of the club face, said second extension portion having a leading edge, a proximal end in the region of the second end of said club face, and a distal end disposed away from said club face, said second extension having a weight joined thereto in the region of the distal end thereof, said weight having a second specific gravity higher than said first specific gravity, wherein the leading edge of at least one of said first and second extension forms an angle of greater than 40° and less than 90° from an imaginary line oriented perpendicular to the club face and passing through at least one of the outermost portions of the club face at the heel or the toe of the club face, and wherein one of the extensions is longer than the other extension, wherein:

(a) said club face has a thickness, and said extensions have a length and a thickness, wherein at least one of the extensions has a thickness measured along at least a portion of its length that is less than the thickness of the club face, wherein the thickness of the club face is measured inclusive of any flange and exclusive of any central element or alignment means extending from the back portion of the club face;

(b) said club face has a top surface, and said extensions have a length and a top surface, wherein at least one of the extensions has a top surface along at least a portion of its length that is lower than the top surface of the club face when the sole of the club head is placed flat on the ground; and (c) the weights have a thickness dimension measured in a direction from the front of the extensions to the rear of the extensions, wherein the thickness of at least one of the weights is greater than the thickness of at least a portion of one of the extensions.

* * * * *